US006589141B1

(12) United States Patent
Flaggs

(10) Patent No.: US 6,589,141 B1
(45) Date of Patent: Jul. 8, 2003

(54) APPARATUS AND METHOD FOR STRETCHING CALF MUSCLES

(76) Inventor: Darryl Flaggs, 2251 Placer Dr., Bay Point, CA (US) 94565

( * ) Notice: Subject to any disclaimer, the term of this patent is extended or adjusted under 35 U.S.C. 154(b) by 0 days.

(21) Appl. No.: 09/452,932

(22) Filed: Dec. 2, 1999

(51) Int. Cl.[7] ..... A63B 21/00
(52) U.S. Cl. ..... 482/79; 482/80
(58) Field of Search ..... 482/146, 79, 80, 482/907, 148, 19, 139, 147, 145, 908, 70, 71; 601/29–32; 128/845

(56) References Cited

U.S. PATENT DOCUMENTS

| | | | |
|---|---|---|---|
| 4,693,470 | A | 9/1987 | Ogawa |
| 5,035,421 | A | 7/1991 | Scheller |
| 5,342,266 | A | 8/1994 | Dailey |
| 5,536,226 | A | 7/1996 | Gordon |
| 5,558,606 | A | 9/1996 | Poncini et al. |

*Primary Examiner*—Jerome W. Donnelly

(57) ABSTRACT

Footwear is employed for stretching an individual's calf muscles. The footwear includes a base member and a foot support member angularly disposed relative to the base member. The angle between the base member and the foot support member can be adjusted.

1 Claim, 4 Drawing Sheets

APPARATUS AND METHOD FOR STRETCHING CALF MUSCLES

TECHNICAL FIELD

This invention relates to a system from stretching a person's calf muscles. The invention incorporates footwear of a specialized nature to be worn by an individual and also to a method incorporating use of the footwear.

BACKGROUND OF THE INVENTION

It is known that stretching of calf muscles increases the ability of an individual to jump. A number of exercises have been employed to stretch calf muscles and Achilles' tendons.

A number of devices have been devised which are aimed at stretching or treating musculature of the lower leg. The following patents disclose devices which are believed to be representative of the state of the art in this field: U.S. Pat. No. 4,693,470, issued Sep. 15, 1987, U.S. Pat. No. 5,035,421, issued Jul. 30, 1991, U.S. Pat. No. 5,536,226, issued Jul. 16, 1996, U.S. Pat. No. 5,558,606, issued Sep. 24, 1996, and U.S. Pat. No. 5342,266, issued Aug. 30, 1994.

The various devices shown in these patents are all characterized by the fact that they are employed at a fixed location during the exercise or therapy. At least some of the devices are relatively complex in nature.

As will be seen below, by way of contrast, the apparatus and method of the present invention result in stretching of the calf muscles and Achilles' tendon by an individual using the apparatus which is in the nature of footwear.

DISCLOSURE OF INVENTION

The present invention encompasses footwear to be worn by an individual for stretching the individual's calf muscles.

The footwear includes a base member having a base member bottom for engaging the ground or other surface, a base member front end and a base member back end.

The footwear also includes a foot support member having a foot support member top, a foot member front end and a foot support member back end. The foot support member is located above the base member.

Connector means connects the foot support member to the base member with the foot support member top disposed at an angle relative to the base member bottom and the foot support member front end positioned at a higher elevation than the foot support member back end.

Attachment means is provided for attaching the footwear to an individual's foot to retain the foot in place on the foot support member top while the individual is stretching calf muscles.

The connector means is adjustable for selectively changing the angle between the foot support member top and the base member bottom.

The method of the invention includes the step of positioning the foot of an individual on a foot support member of footwear including the foot support member and a base member connected to the foot support member.

The foot support member is inclined relative to the base member to define an angle therebetween whereby the individual's foot on the support member is angled upwardly in the direction of the front of the foot.

The individual pivots his or her leg relative to the foot in the footwear while maintaining the foot support member inclined relative to the base member.

The relative orientations of the foot support member and the base member are periodically adjusted to gradually increase the angle defined between the foot support member and the base member.

Other features, advantages, and objects of the present invention will become apparent with reference to the following description and accompanying drawings.

BEST MODE FOR CARRYING OUT THE INVENTION

Figure 1:
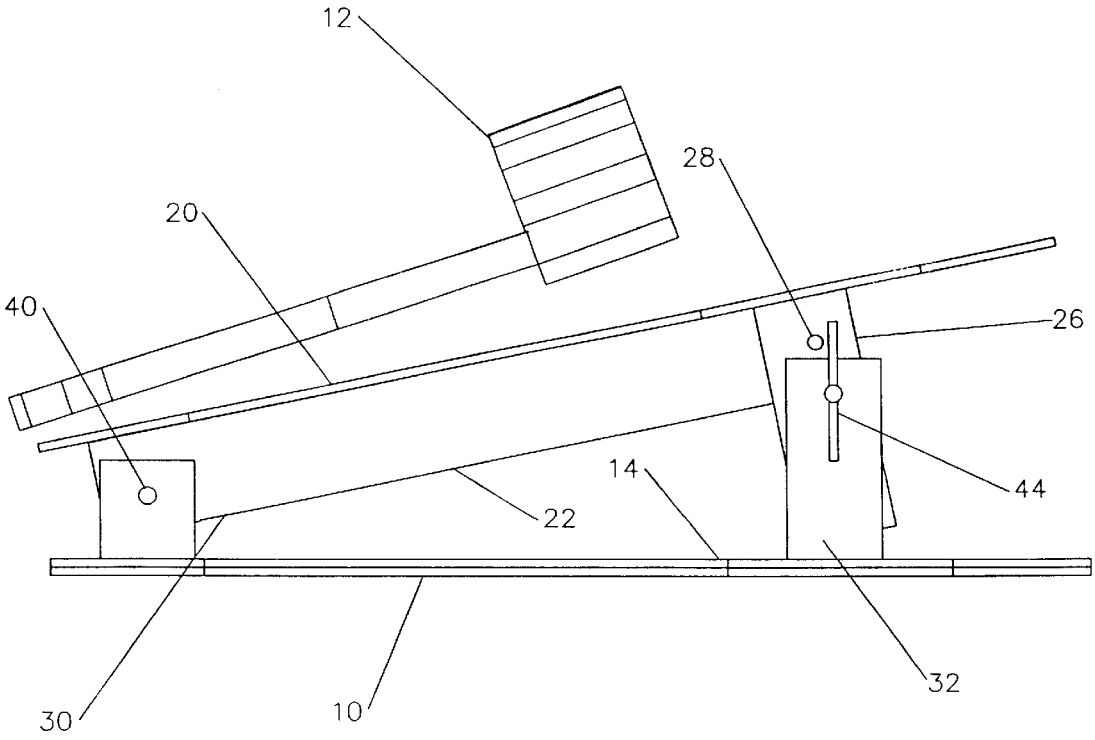
FIG. 1 is a side elevational view of apparatus constructed in accordance with the teachings of the present invention in a configuration wherein the foot support member is inclined relative to the base member of the apparatus.

Referring now to the drawings, footwear constructed in accordance with the teachings of the present invention includes a base member 10 and a foot support member 12. The base member 10 is of two-part construction, including a flat rigid plate 14 of metal, plastic or the like and a resilient undersole 16 formed of rubber or other suitable material. The plate and undersole are secured together by adhesive or any other suitable expedient.

The foot support member 12 includes a rigid plate 20 and a support frame 22 to which the plate 20 is fastened.

Figure 4:
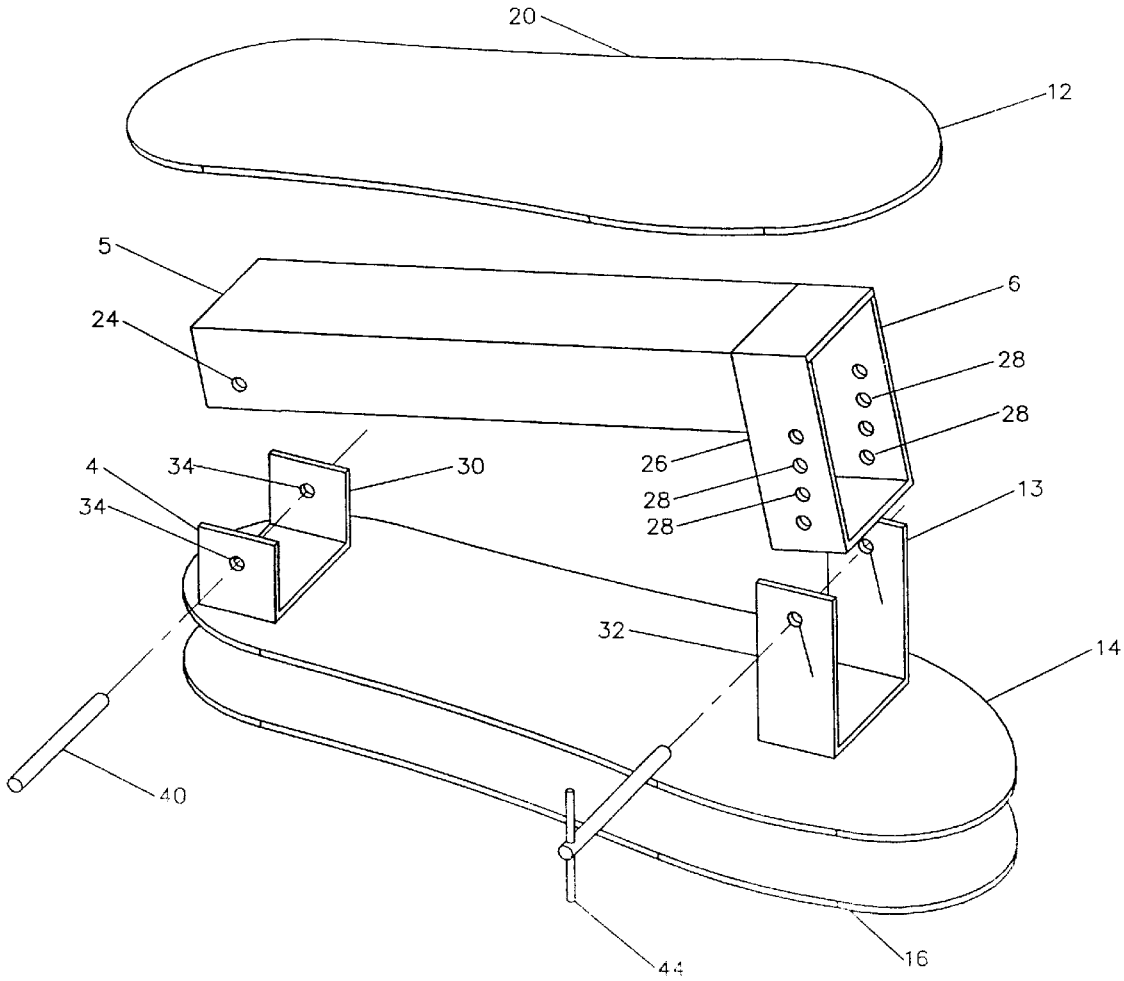
FIG. 4 is an exploded view illustrating elements of the apparatus.

Secured to frame 22 at the front end thereof is a bracket 26 having two parallel legs with holes 28 formed therein at spaced locations and in an arcuate pattern. Holes 24 project through both sides of support frame 22 at the back end thereof, only one such hole 24 being shown in FIG. 4.

Welded or otherwise secured to plate 14 of the base member are double-legged brackets 30, 32. Aligned 34 are formed in the upwardly extending legs of brackets 30, 32.

A pivot pin 40 passes through holes 34 of bracket 30 and holes 24 of frame 22 to pivotally connect the back or rear ends of the base member and foot support member together.

A lock pin 44 is employed to interconnect brackets 26 and 32 by passing through aligned holes 34, 28. The base member and the foot support member are thus positioned so that the foot support member is located above the base member and the foot support member top is disposed at an angle relative to the base member bottom. The foot support front end (the end disposed toward the right in all of the figures) is positioned at a higher elevation than the foot support member back end.

Figure 2:
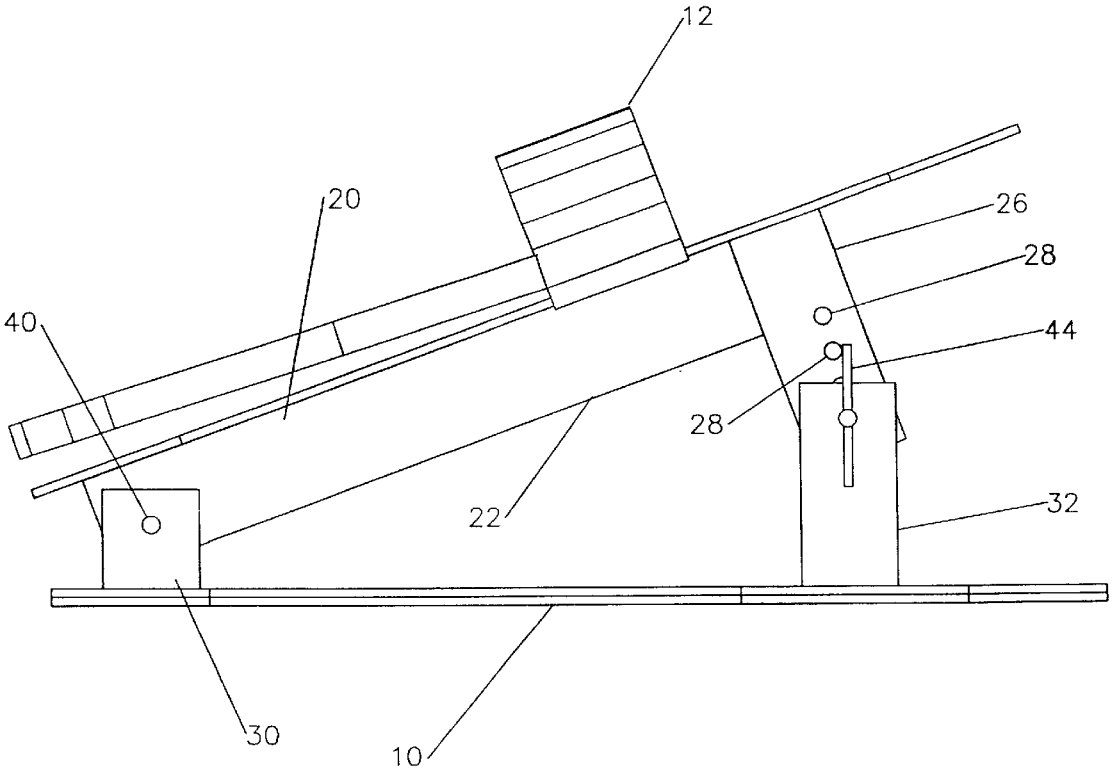
FIG. 2 is a view similar to FIG. 1 but illustrating a greater degree of inclination between the foot support member and base member than that illustrated in FIG. 2.

The angle between the foot support member top and the base member bottom can be changed depending upon which set of aligned holes 28 in bracket 26 accommodates the lock pin 44. FIG. 1 shows a relatively small angle and FIG. 2 discloses a larger angle.

In use, an individual will place his or her foot on and flat against the plate 20 of foot support member 12 with the front of the foot disposed at the front of the plate (the right end of the plate as shown in the drawings). A securement strap 50 (in the interest of simplicity shown in FIG. 3 only) is employed to secure the user's foot to the foot support member so that he or she can utilize the footwear. This is accomplished by placing the footwear at a desired location, for example behind the user's other foot in a conventional position used when carrying out stretching activities in the conventional manner. The user flexes the leg by pivoting it about the ankle interconnecting the leg to the foot on the support member of the footwear. The positioning of the footwear can readily be changed as desired. It will be appreciated that a greater amount of stretching can occur than if the foot were directly flat on the ground.

Figure 3:
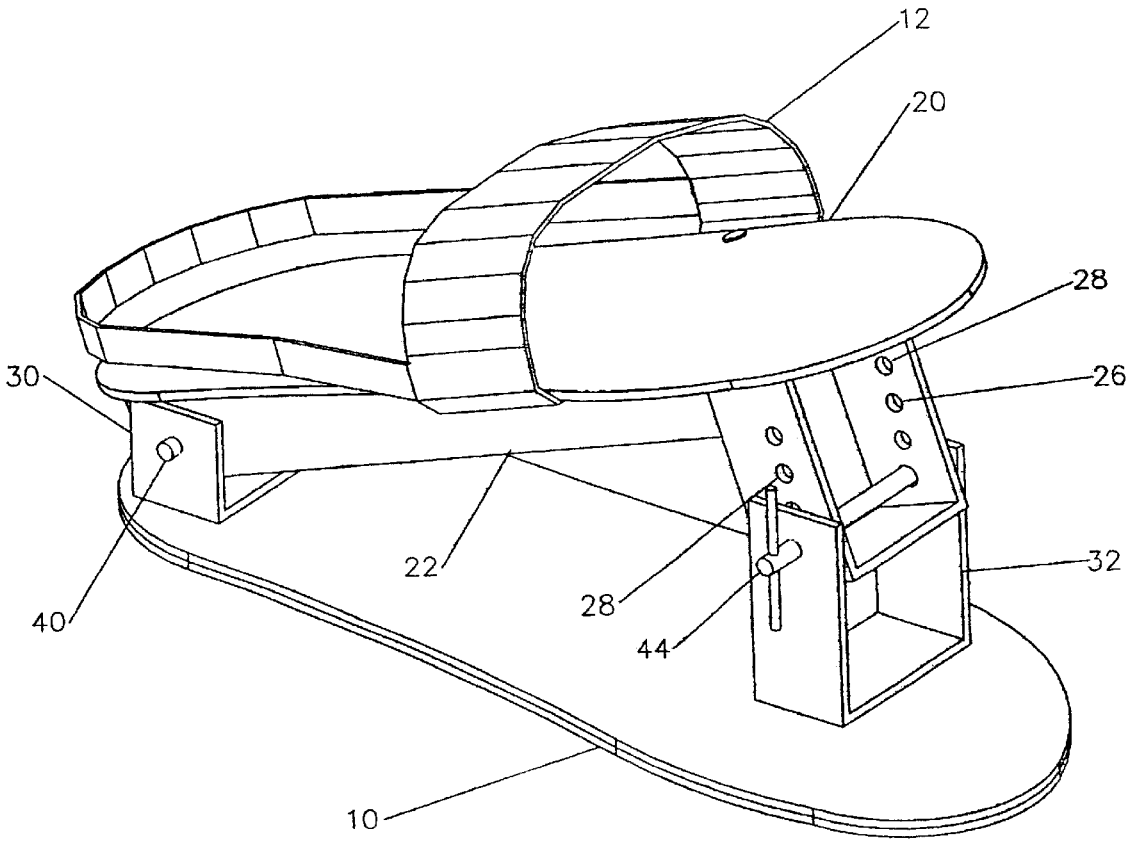
FIG. 3 is a perspective view of the apparatus.

It is preferable not to put too much stress on the calf muscles or Achilles' tendon when exercising with the footwear of the present invention. For this reason it is preferred that the angle between the base member and the foot support member be relatively small at the start. The angle can be periodically gradually increased by inserting the lock pin 44 in different aligned sets of holes 28 in bracket 26. FIG. 3 shows the maximum angle that can be defined between the base member and foot support member.

In practice, the footwear can be worn on both feet, the user shifting feet places by occasionally moving the front foot and footwear worn thereon to rear position and vice versa.

What is claimed is:

1. A device for stretching an individual's calf muscles which consists of: a base plate for resting on the ground and a foot plate hinged to the back end of the base plate, and; a strap permanently attached to the foot plate and adapted, to secure the user's entire foot to the foot plate after the angle has been adjusted and locked in place the angle of which is adjustable and which can be locked in place by inserting a cylindrical pin through the appropriate holes in vertical extensions from the bottom which slide alongside vertical extensions from the base plate which contain a corresponding hole on each.

* * * * *